United States Patent [19]

Blasko et al.

[11] Patent Number: 5,030,127

[45] Date of Patent: Jul. 9, 1991

[54] MANUALLY DISENGAGEABLE CONNECTOR LOCK

[75] Inventors: Raymond J. Blasko, Poland; John M. Sova, Cortland, both of Ohio

[73] Assignee: General Motors Corporation, Detroit, Mich.

[21] Appl. No.: 483,545

[22] Filed: Feb. 20, 1990

[51] Int. Cl.[5] ..... H01R 13/627

[52] U.S. Cl. ..... 439/353; 439/358

[58] Field of Search ..... 439/358, 352, 353, 357, 439/190, 191, 192, 865

[56] References Cited

U.S. PATENT DOCUMENTS

| | | | |
|---|---|---|---|
| 2,748,362 | 5/1956 | Andis | 439/353 X |
| 4,602,839 | 7/1986 | Winger | 439/358 |
| 4,634,204 | 1/1987 | Detter et al. | 339/91 |
| 4,640,567 | 2/1987 | Lundergan et al. | 339/94 |
| 4,857,008 | 8/1989 | Kee et al. | 439/358 |
| 4,915,648 | 4/1990 | Takase et al. | 439/353 |
| 4,950,179 | 8/1990 | Takenouchi et al. | 439/352 |

*Primary Examiner*—Larry I. Schwartz
*Assistant Examiner*—Julie R. Daulton
*Attorney, Agent, or Firm*—F. J. Fodale

[57] ABSTRACT

Male and female electrical connectors are locked together by a resilient cantilevered lock arm of the male insulator body engaging a latching member of the female insulator body. The lock arm has a T-shaped member at its free end which provides a thumb pad for depressing the lock arm and disconnecting the electrical connectors.

10 Claims, 1 Drawing Sheet

MANUALLY DISENGAGEABLE CONNECTOR LOCK

BACKGROUND OF THE INVENTION

This invention relates generally to electrical connectors and more specifically to electrical connectors which have a connector lock for locking the electrical connectors together comprising a resilient lock arm forming part of the thermoplastic insulator body of one of the electrical connectors.

U.S. Pat. No. 4,634,204 granted to Gary C. Detter et al Jan. 6, 1987 discloses matable male and female electrical connectors which are locked together by a resilient lock arm of the male insulator body engaging a lock bar of the female insulator body. The lock arm has a raised lock tab at its leading end. The raised lock tab includes a forward facing inclined ramp and a rearward facing lock shoulder. During mating, the inclined ramp engages an inclined camming surface of the lock bar which deflects the lock arm inwardly until the raised lock tab passes under the lock bar whereupon the resilient lock arm springs back so that the lock shoulder engages behind a latching surface of the lock bar. In order to disconnect the male and female electrical connectors, the resilient lock arm must be depressed by a pick or other suitable tool so that the raised lock tab passes under the lock bar when the male and female electrical connectors are pulled apart.

U.S. Pat. No. 4,640,567 granted to Robert G. Lundergan et al Feb. 3, 1987 discloses matable male and female electrical connectors which are locked together by resilient lock arms of the male insulator body engaging latching members of the female insulator body. The lock arms have camming wedges at their distal ends. During mating the camming wedges are deflected inwardly by camming surfaces of the latching members until the camming wedges pass through the latching members whereupon the resilient lock arms spring back so the backs of the camming wedges engage behind latching surfaces of the latching members. In order to disconnect the male and female electrical connectors, the cantilevered lock arms must be depressed simultaneously so that the camming wedges pass through the latching members inwardly of the camming wedges when the male and female electrical connectors are pulled apart. The resilient lock arms appear to include medially located pads for simultaneously depressing the resilient lock arms toward each other.

SUMMARY OF THE INVENTION

The object of this invention is to provide an electrical connector lock arrangement of the above noted type which is improved so that the electrical connector is easily disconnected without the use of any tools.

Another more specific object of this invention is to provide an electrical connector with a cantilevered lock arm which is designed to minimize the manual effort required to depress the lock arm so that the electrical connector is easily disconnected.

Yet another object of this invention is to provide an electrical connector with a cantilevered lock arm which is designed so that the lock arm may be depressed and the electrical connector disconnected single-handedly.

Still yet another object of this invention is to provide an electrical connector which is shaped to prevent accidental disengagement of a manually depressible lock arm of a cooperating electrical connector.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
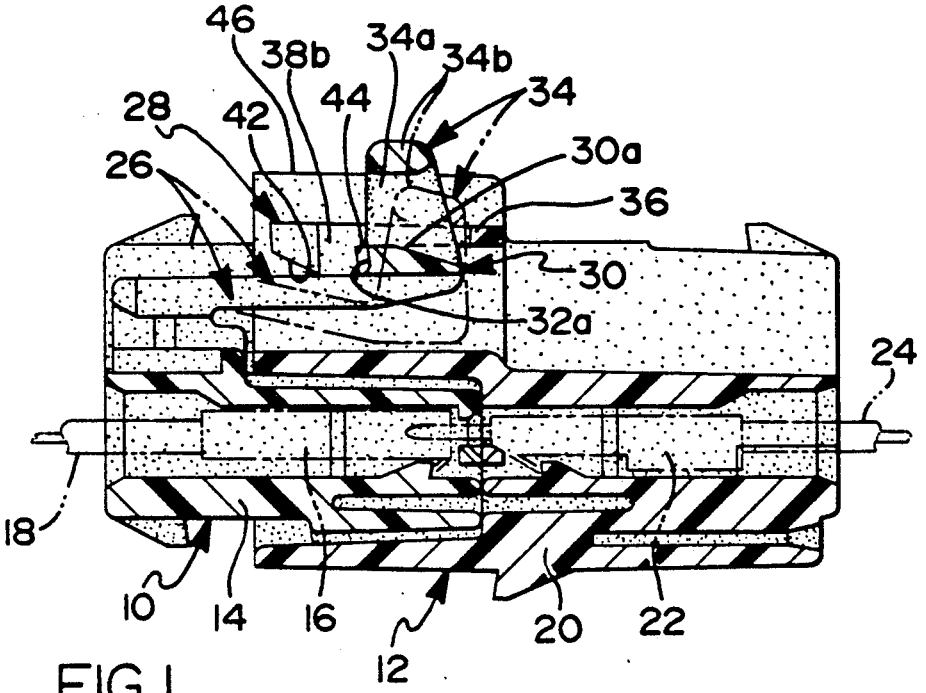
FIG. 1 is a longitudinal cross section of mated male and female electrical connectors equipped with a connector lock in accordance with this invention.

Referring now to the drawing, FIG. 1 shows female and male electrical connectors 10 and 12 connected to each other which are equipped with a connector lock in accordance with this invention, which locks the electrical connectors together.

The female connector 10 comprises an insulator body 14 which houses a plurality of electric terminals 16 which are attached to the ends of electric cables 18. The male connector likewise comprises an insulator body 20 which houses a plurality of electric terminals 22 which are attached to the ends of electric cables 24. The electric terminals 16 mate with the electric terminals 22 when the electrical connectors 10 and 12 are connected together to provide electrical continuity between the electric cables 18 and 24.

Figure 2:
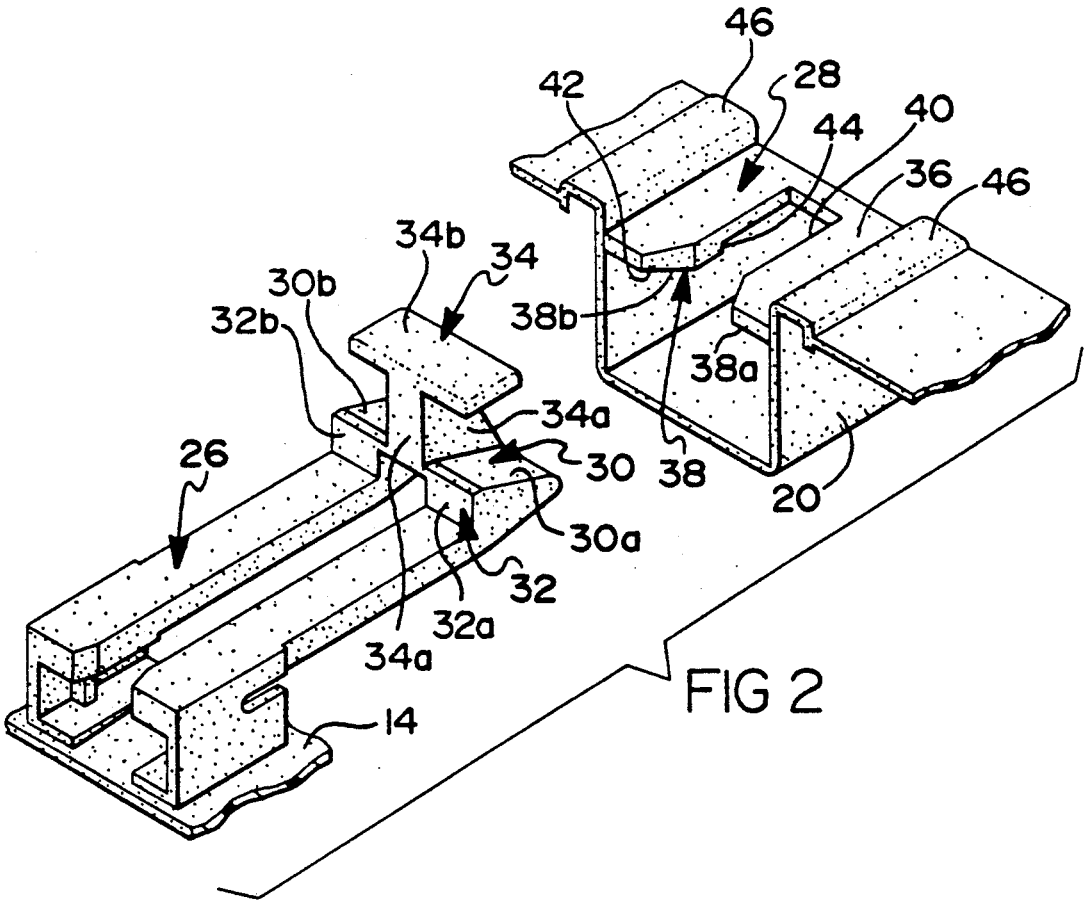
FIG. 2 is a fragmentary perspective view of the connector lock portions of the electrical connectors of FIG. 1 showing the electrical connectors disconnected.

The connector lock for locking the electrical connectors 10 and 12 together comprises a resilient cantilevered lock arm 26 which is molded as an integral part of the plastic insulator body 14 of the female electrical connector 10 and a cooperating latching member 28 which is molded as an integral part of the plastic insulator body 20 for the male connector 12. The lock arm 26 and latching member 28 are shown in the engaged or locked position in FIG. 1 and in a disconnected position in FIG. 2.

The lock arm 26 has a camming wedge 30 at its free end which leads to a raised lock shoulder 32. The lock arm 26 also has a T-shaped member 34 at its free end. The T-shaped member 34 includes a stem **34*a* which bifurcates the camming wedge so that camming wedges 30*a* and 30*b* and lock shoulders 32*a* and 32*b* are provided on each side of the stem 34*a*. The T-shaped member 34 further includes a cross piece which provides a thumb pad 34*b*. The thumb pad 34*b* is spaced outwardly of the lock shoulders 32*a* and 32*b* by the stem 34*a*** by a predetermined amount as explained in more detail below.

The latching member 28 comprises a cross bar or plate 36 which is formed on the insulator body 20 so that there is a substantial space inwardly of the plate 36 for receiving the lock arm 26 when the electrical connectors 10 and 12 are connected together. The plate 36 has a depending nib 38 which extends inwardly into the space which receives the lock arm 26. The plate 36 also has a longitudinal slot 40 which divides the depending nib 38 into two nibs **38*a* and 38*b* which have camming surfaces 42 and latching surfaces 44 on either side of the slot 40**.

When the female and male electrical connectors 10 and 12 are connected together, the camming wedges 30*a* and 30*b* at the end of the lock arm 26 enter the space inward of the plate 36 and engage the camming surfaces 42 of the depending nibs 38*a* and 38*b* which deflect the lock arm 26 inwardly until the camming wedges 30*a* and 30*b* pass the depending nibs 38*a* and 38*b* and the lock arm 26 springs back so that the lock shoulders 32*a* and 32*b* engage behind the latching surfaces 44 of the depending nibs 38*a* and 38*b* as shown in FIG. 1. In this locked position the thumb pad 34*b* is spaced outwardly of the plate 38 by the stem 34*a* which protrudes through the longitudinal slot 40. The lock shoulders 32*a* and 32*b* of the lock arm 26 and the cooperating latching surfaces 44 of the depending nibs 38 both have matching back angles of about 15 degrees so that the lock shoulders 32*a* and 32*b* are pulled into tighter engagement with the latching surfaces 44 when an attempt is made to pull the connectors apart without releasing the lock arm 26.

The lock arm 26, which is bifurcated for increased resilience, is released by depressing the thumb pad 34*b* which deflects the free end of the lock arm 26 inwardly so that the lock shoulders 32*a* and 32*b* are free of the lock surfaces 44. It should be noted that the stem 34*a* spaces the thumb pad 34 outwardly of the lock shoulders 32*a* and 32*b* by a sufficient amount so that lock shoulders 32*a* and 32*b* are in fact free when the thumb pad 34 is depressed. Moreover, as shown in dotted lines in FIG. 1. the stem 34*a* is preferably sized so that the thumb pad 34*b* engages the top of the plate 36 of the latching member 28 when the lock shoulders 32*a* and 32*b* are free of the latching surfaces 44 (and the connector body 20 for that matter) thereby providing a tactile signal to the operator that the lock arm 26 is released and that the electrical connectors 10 and 12 may be pulled apart.

Thus the electrical connectors 10 and 12 may be disconnected simply by depressing the thumb pad 34*b* until it bottoms out on the top of the plate 36 and then pulling the electrical connectors 10 and 12 apart.

This may be done single-handedly if the electrical connector 12 is secured in place by grasping the insulator body 14 with the fingers of one hand, releasing the lock arm 26 by depressing the thumb pad 34 with the thumb of that hand and then pulling the electrical connector 10 away.

It should also be noted that the connectors 10 and 12 can be disconnected single-handedly if low terminal engagement forces are involved, such as in a one or two way connector, by grasping the insulator body 20 with the fingers of one hand, releasing the lock arm 26 by depressing the thumb pad 34 with the thumb of that hand and then disconnecting the electrical connectors by pushing the thumb pad 34*b* and electrical connector 10 away from the electrical connector 12 with this same thumb.

It should also be noted that the insulator body 20 is formed with raised guard surfaces 46 on either side of the latch plate 36. These guard surfaces 46 are spaced less than a thumb width apart but far enough apart so that the operator's thumb can depress the thumb pad 34 down against the top of the lock plate 36. However, the surfaces 46 are spaced outwardly of the latch plate 36 by a sufficient amount so that the lock shoulders 32*a* and 32*b* still engage the latching surfaces 44 when the thumb pad 34 is depressed only to the level of the guard surface 46. This prevents accidental disengagement of the manually depressible lock arm 26.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In an electrical connector lock for electrical connectors which are locked together by a resilient cantilevered lock arm of an insulator body of one electrical connector engaging a latch member of an insulator body of another electrical connector or the like, the lock arm having a camming wedge at a free end which cooperates with a camming surface of the latch member to deflect the lock arm inwardly during locking movement until the camming wedge passes the camming surface and the lock arm springs back so that a lock shoulder of the lock arm engages behind a latching surface of the latch member, the improvement comprising;

the lock arm having a thumb pad at the free end of the lock arm which is depressed to deflect the lock arm inwardly for disconnecting the one electrical connector from the other electrical connector or the like, and the thumb pad being directly above and spaced radially outwardly of the lock shoulder by a sufficient amount so that the lock shoulder is free of the lock surface when the thumb pad is depressed to deflect the lock arm inwardly.

2. The improvement as defined in claim 1 wherein the lock arm has a T-shaped member at the free end of the lock arm which includes a cross piece which is spaced radially outwardly of the lock arm to provide the thumb pad.

3. The improvement as defined in claim 1 wherein the lock arm has a member at the free end of the lock arm comprising a stem and a cross piece which is spaced radially outwardly of the lock arm to provide the thumb pad.

4. In an electrical connector lock for electrical connectors which are locked together by a resilient cantilevered lock arm of an insulator body of one electrical connector engaging a latch member of an insulator body of another electrical connector or the like, the lock arm having a camming wedge at a free end which cooperates with a camming surface of the latch member to deflect the lock arm inwardly during locking movement until the camming wedge passes the camming surface and the lock arm springs back so that a lock shoulder of the lock arm engages behind a latching surface of the latch member, the improvement comprising;

the lock arm having a T-shaped member at the free end of the lock arm which provides a thumb pad which is depressed to deflect the lock arm inwardly for disconnecting the one electrical connector from the other electrical connector or the like, the thumb pad being spaced outwardly of the lock shoulder by a sufficient amount so that the lock shoulder is free of the lock surface when the thumb pad is depressed to deflect the lock arm inwardly, and the latch member including a plate having a depending nib which provides the camming surface and the latching surface and a longitudinal slot to accommodate a stem of the T-shaped member at the free end of the lock arm.

5. The improvement as defined in claim 4 wherein the stem is sized so that the thumb pad engages a top of the plate to signal that the lock shoulders are free of the latching surfaces.

6. The improvement as defined in claim 4 wherein the stem bifurcates the camming wedge and the lock shoulder so that the lock arm has a camming wedge and a lock shoulder on each side of the stem and wherein the longitudinal slot bifurcates the depending latch nib so that the plate has a depending latch nib on each side of the longitudinal slot.

7. The improvement as defined in claim 6 wherein the stem is sized so that the thumb pad engages a top of the plate to signal that the lock shoulders are free of the latching surfaces.

8. The improvement as defined in claim 4 wherein the insulator body having the latch member has a guard surface on each side of the plate which are spaced outwardly of the plate so that the lock shoulder of the latch arm still engages the latch surface of the depending nib when the thumb pad is depressed to a level defined by the guard surfaces.

9. The improvement as defined in claim 7 wherein the insulator body having the latch member has a guard surface on each side of the plate which are spaced outwardly of the plate so that the lock shoulder of the latch arm still engages the latch surface of the depending nib when the thumb pad is depressed to a level defined by the guard surfaces.

10. In an electrical connector lock for electrical connectors which are locked together by a resilient cantilevered lock arm of an insulator body of one electrical connector engaging a latch member of an insulator body of another electrical connector or the like, the lock arm having a camming wedge at a free end which cooperates with a camming surface of the latch member to deflect the lock arm inwardly during locking movement until the camming wedge passes the camming surface and the lock arm springs back so that a lock shoulder of the lock arm engages behind a latching surface of the latch member, the improvement comprising:

the lock arm having a member at the free end of the lock arm comprising a stem and a thumb pad which is depressed to deflect the lock arm inwardly for disconnecting the one electrical connector from the other electrical connector or the like, the thumb pad being spaced outwardly of the lock shoulder by a sufficient amount so that the lock shoulder is free of the lock surface when the thumb pad is depressed to deflect the lock arm inwardly, and the latch member including a plate having a depending nib which provides the camming surface and the latching surface and a longitudinal slot to accommodate the stem of the member at the free end of the lock arm.

* * * * *